US005815956A

United States Patent [19]

Lavin et al.

[11] Patent Number: 5,815,956

[45] Date of Patent: Oct. 6, 1998

[54] VEHICLE MOUNTING ASSEMBLY FOR A SNOW PLOW WITH HIDDEN ACTUATOR DRIVE

[75] Inventors: Kevin R. Lavin, Princeton; Marc D. Curtis, Spencer, both of Mass.

[73] Assignee: Curtis International , Inc., Worcester, Mass.

[21] Appl. No.: 640,145

[22] Filed: Apr. 30, 1996

[51] Int. Cl.[6] ..... E01H 6/00

[52] U.S. Cl. ..... 37/241; 37/231; 37/232; 37/234; 37/236; 172/273

[58] Field of Search ..... 37/241, 231, 232, 37/233, 234, 235, 236; 172/275, 445.2, 273

[56] References Cited

U.S. PATENT DOCUMENTS

| | | | |
|---|---|---|---|
| 3,332,562 | 7/1967 | Kokott | 37/236 X |
| 3,524,269 | 8/1970 | Jackoboice | 37/231 X |
| 3,659,362 | 5/1972 | Bell | 172/275 X |
| 3,769,724 | 11/1973 | Norgaard | 37/236 |
| 4,244,122 | 1/1981 | Hetrick | 37/236 X |
| 4,403,432 | 9/1983 | Biance | 172/445.2 X |
| 4,439,939 | 4/1984 | Blau | 37/231 |
| 4,470,211 | 9/1984 | Rossmann | 37/231 |
| 4,962,598 | 10/1990 | Woolhiser et al. | 37/231 |
| 4,991,323 | 2/1991 | Benkler | 37/231 X |
| 4,999,935 | 3/1991 | Simi et al. | 37/236 |
| 5,036,608 | 8/1991 | Ciula | 37/231 X |
| 5,111,603 | 5/1992 | Knowlton et al. | 37/231 |
| 5,125,174 | 6/1992 | Watson et al. | 37/231 |
| 5,195,261 | 3/1993 | Vachon | 37/231 |
| 5,353,530 | 10/1994 | Pieper | 37/231 |
| 5,479,730 | 1/1996 | Gogan | 37/231 |
| 5,568,694 | 10/1996 | Capra et al. | 37/231 |
| 5,595,007 | 1/1997 | Biance | 172/445.2 X |

FOREIGN PATENT DOCUMENTS

| | | |
|---|---|---|
| 2121948 | 10/1994 | Canada . |
| 2123340 | 9/1995 | Canada . |

*Primary Examiner*—Terry Lee Melius
*Assistant Examiner*—Victor Batson
*Attorney, Agent, or Firm*—Nields, Lemack & Dingman

[57] ABSTRACT

A mount and lift assembly for hydraulically driven snow blades or other accessories that includes a chassis frame for mounting to the vehicle chassis; a lift frame mount readily removably coupled to the chassis frame; an A-frame mount readily removably coupled to the chassis frame, the A-frame supporting an actuator drive such as an electric/hydraulic pump to drive the snow blade; a blade trip frame coupled to the A-frame; and a snow blade removably coupled to the trip frame.

9 Claims, 9 Drawing Sheets

VEHICLE MOUNTING ASSEMBLY FOR A SNOW PLOW WITH HIDDEN ACTUATOR DRIVE

BACKGROUND OF THE INVENTION

Conventional snow blade mounts for four wheel drive vehicles such as pick-up trucks can weigh several hundred pounds, and generally include a chassis frame that can be permanently fixed to the vehicle chassis, usually behind the vehicle front bumper. A lift frame is then removably coupled to the chassis frame, and the snow blade is then coupled to the front end of the assembly via an A-frame and trip frame assembly. The A-frame with the snow blade attached is usually removable from the vehicle. Conventionally, the lift frame has been permanently mounted to the chassis frame (and therefore not readily removable from the vehicle), and the hydraulic pump used to operate the snow blade was located under the vehicle hood, and were driven using a belt drive driven by the vehicle engine. However, safety considerations now often dictate that the lift frame be removed when the plow is not in use. In addition, crash zones and barrier testing are altered by locating the electric/hydraulic pump under the vehicle hood in juxtaposition with the vehicle engine. Moreover, such a location is also no longer feasible since there is little room there to accommodate the pump, and since most vehicles today use a single serpentine belt, again eliminating the feasibility of driving the hydraulics with a belt driven by the vehicle engine.

Accordingly, most snow blade mounts today locate the blade actuator drive assembly in front of the vehicle grill, generally slightly higher than the vehicle front bumper. With the actuator drive assembly in this location, care must be taken to allow sufficient free space to accommodate the lift and tilt of the snow blade without it contacting and potentially damaging the actuator drive assembly. This problem is especially apparent in another conventional snow blade mounting assembly where the actuator drive assembly is mounted on top of the A-frame and against the stabilizer ring. Another perhaps more significant disadvantage of actuator drive location in front of the vehicle grill or radiator is that the actuator blocks air flow into the vehicle engine. As a result, vehicle engine over-heating is a common occurrence.

A further drawback of conventional snow blade mounts is the difficulty in readily removing the lift frame assemblies from the vehicle chassis, especially in view of their weight. To that end, U.S. Pat. No. 5,125,174 discloses a removable snowplow including a removable lift frame and A-frame combination. However, the lift frame assembly is permanently mounted to the A-frame, thus requiring removal of both simultaneously, as a unit. U.S. Pat. No. 5,353,530 is of a similar vein.

It is therefore an object of the present invention to provide a snow blade mount and lift assembly for a vehicle that does not significantly block air flow to the vehicle engine.

It is a further object of the present invention to provide a hydraulically operated snow blade and lift assembly for a vehicle that locates the electric/hydraulic pump in an area that does not obstruct air flow to the vehicle engine.

It is a still further object of the present invention to provide a snow blade lift assembly that is easily attachable and detachable from a vehicle chassis.

It is yet a further object of the present invention to provide a chassis frame that can accommodate additional accessories when the snow blade is not mounted thereto.

SUMMARY OF THE INVENTION

The problems of the prior art have been overcome by the present invention, which provides a mount and lift assembly for hydraulically driven snow blades or other accessories that includes a chassis frame for mounting to the vehicle chassis; a lift frame mount readily removably coupled to the chassis frame; an A-frame mount readily removably coupled to the chassis frame, the A-frame supporting an actuator drive such as an electric/hydraulic pump to drive the snow blade; a blade trip frame coupled to the A-frame; and a snow blade removably coupled to the trip frame.

DETAILED DESCRIPTION OF THE INVENTION

Figure 1:
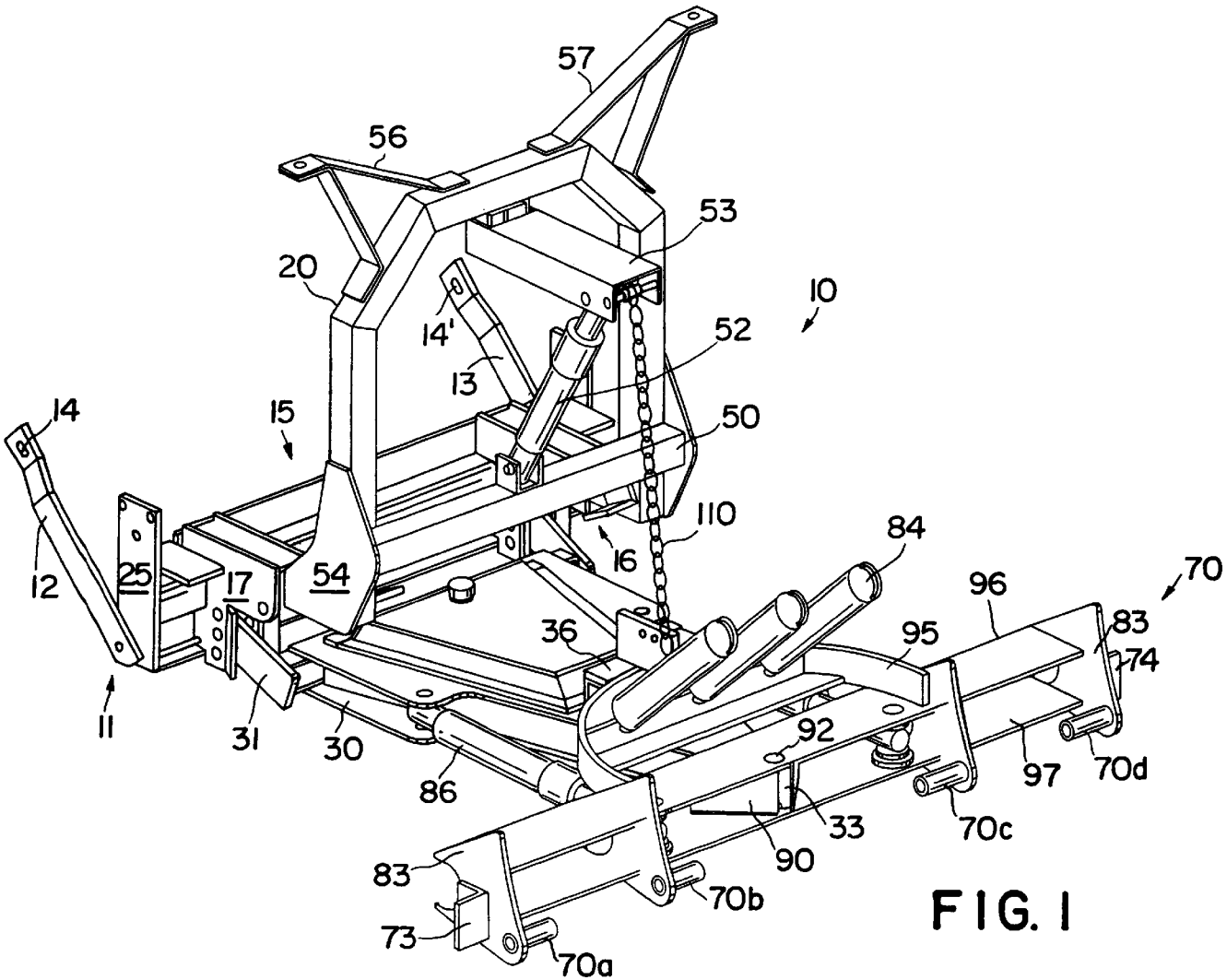
FIG. 1 is a perspective view of the snow blade mounting system in accordance with the present invention.
Figure 2:
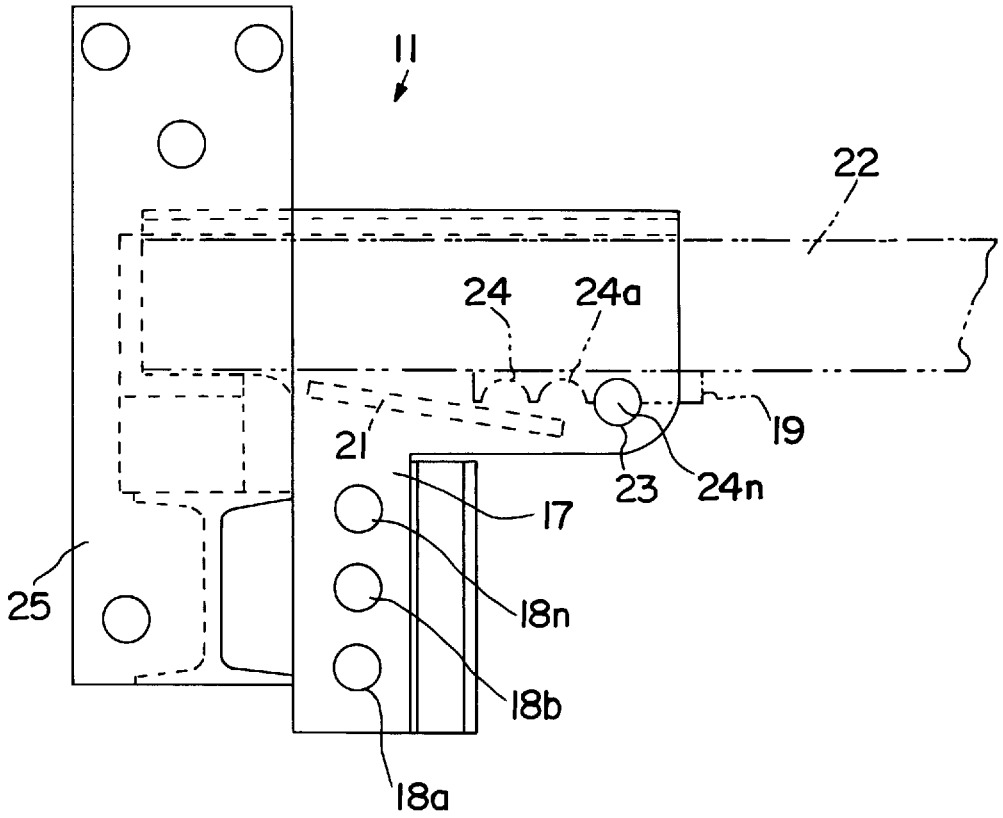
FIG. 2 is a side view of the vehicle mounted chassis frame in accordance with the present invention.

Turning first to FIG. 1, there is shown generally at 10 the snow blade lift assembly in accordance with a preferred embodiment of the present invention. Vehicle mounted chassis frame 11 includes opposite ears 12, 13 for attaching the chassis frame to the vehicle chassis behind the front bumper by means of pins or bolts (not shown) through apertures 14, 14' in each of the ears. The chassis frame 11 shown is suitable for mounting to General Motors vehicles; those skilled in the art will recognize that minor modifications can be made to adapt the frame 11 to the differences in chassis of other vehicles for suitable mounting thereto. Regardless of the vehicle chassis make, the forward components that mate to the chassis frame 11 are essentially universal, and thus the components of the chassis frame 11 that accept such components will generally not vary in design, except perhaps for the height relationship between where the lift frame 20 and the A-frame 30 mount. The chassis frame 11 preferably remains permanently mounted to the vehicle chassis, regardless of whether the snow blade or other accessories are in use. It is fixed and has no moving parts; its main purpose being to provide a means of attachment of the follow-on components, such as those that provide the lift and angle of the snow blade where the follow-on component is a snow blade, and to absorb and transfer any shock loads imposed on the snow blade (or other accessory) into the vehicle chassis.

Figure 8:
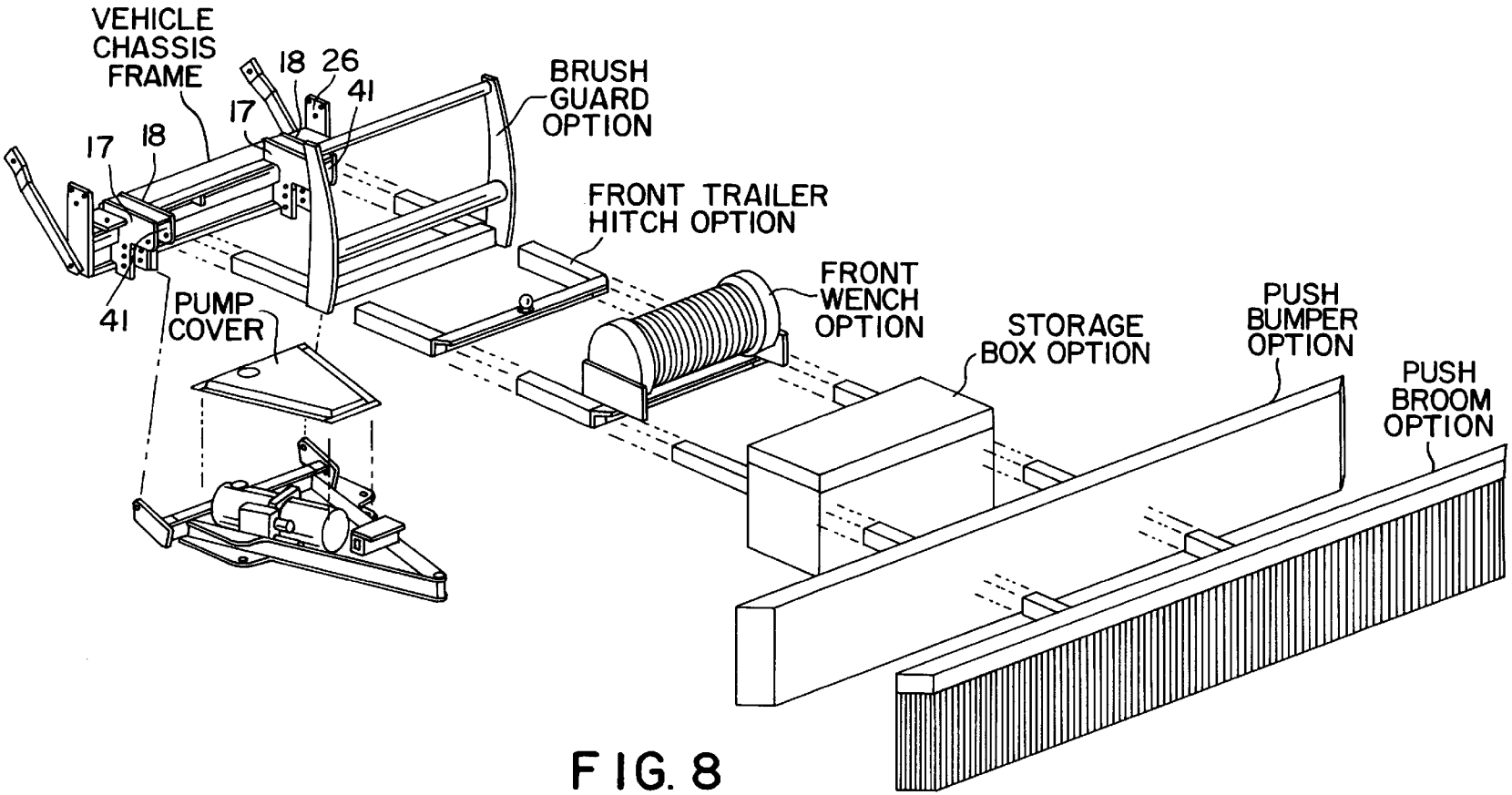
FIG. 8 is a perspective, exploded view of the vehicle mounted chassis frame accommodating various accessories in accordance with the present invention.

The vehicle mating side 15 of the chassis frame 11 is essentially conventional, and familiarity therewith by those skilled in the art is assumed. The accessory mating side 16, however, is unique. Specifically, with reference to FIGS. 1 and 2, a receiver arrangement is created for the removable lift frame 20, or for any other accessory to be attached to the vehicle via the chassis frame 11. A pair of spaced sockets 40, 41 (best seen in FIG. 8) are each defined by a pair of spaced clevis ears 17, 18 integrated into opposite side plates 25, 26 to provide added strength. Each clevis ear 17, 18 has a plurality of axially aligned pin holes 18*a*, 18*b*, 18*n* (three shown) for attachment of the A-frame as described below. An angled transverse plate 21 is located within each socket 40, 41 and provides an entry angle to aid receipt of opposite removable spaced lift frame tubes 22, 22' (FIG. 3) (or similar tubes from any other accessory). The tubes 22, 22' each include a saddle block 19 and pin assembly so that they can be removably secured in the sockets 40, 41 of the vehicle mounted chassis frame 11 via axially aligned pin holes 23, 23*a* in each clevis pair 17, 18. Each saddle block assembly 19 is provided with a plurality of saddles 24, 24*a*, 24*n* (three shown) to allow for appropriate forward and rear adjustment of tubes 22, 22' relative to the vehicle. In the embodiment shown, the saddles are spaced so that adjustment between each saddle is ⅞". The dimensions of each socket are slightly larger than the outside dimensions of each tube 22, 22', in order to allow for easy alignment of each tube within each socket, and to provide for suitable play of each tube within each socket to greatly reduce the potential for corrosion build-up, which can undesirably but effectively weld or lock the lift frame (or other accessory) in the chassis mount 11. However, when the pins are in place through holes 23, 23*a*, the tubes 22, 22' are locked in place. Further reduction in corrosion build-up is achieved since the sockets are substantially U-shaped and therefore essentially open at the bottom, allowing for fluid drainage by the force of gravity.

Figure 3:
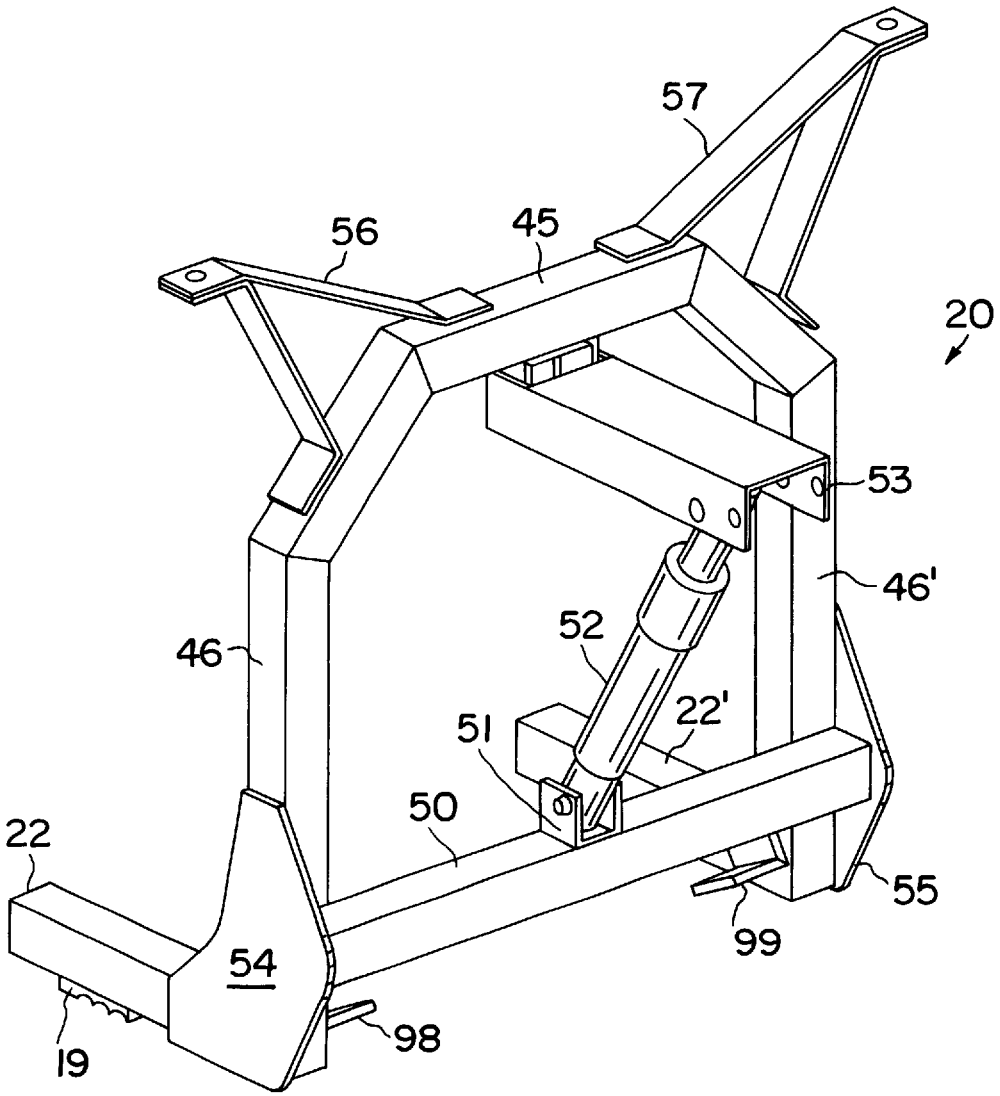
FIG. 3 is a perspective view of the lift frame assembly in accordance with the present invention.

FIG. 3 illustrates the tubular lift frame 20 that is adapted to be releasably coupled to the chassis frame 11. The lift frame 20 as shown has a trapezoidal shape, although the present invention is not to be so limited. A transverse vertical actuator support tube 50 is coupled to the frame 20 between side gusset plates 54, 55, and includes a central bracket 51 for attachment of one end of a vertical lifting means 52 such as a hydraulically driven actuator or cylinder. The opposite end of the vertical lifting means 52 is coupled to U-shaped pivot hood 53, which in turn is pivotally mounted to the underside of top cross bar 45 of the frame 20 as shown. The pivot hood 53 has means to which one operative end of a linking means such as a chain 110 or the like can be mounted. The other operative end of the linking means is mounted to the A-frame by any suitable means (FIG. 1), so that actuation of the vertical lifting means 52 causes a corresponding vertical lift of the hood 53, which thereby lifts the A-frame coupled thereto via the linking means. Lifting of the A-frame lifts the snow blade pivotally coupled thereto (via the trip frame in accordance with the preferred embodiment). The opposite parallel tubes 22, 22' that mate to the chassis frame 11 are shown coupled to vertical legs 46, 46' of the lift frame 20 , and are supported in part by opposite side gusset plates 54, 55. Triangular light mounts 56, 57 are provided on the frame 20 to support additional lighting or the like. Fixed to inside edges of the legs 46, 46' of the lift frame 20 are opposite right angle A-frame limit stops 98, 99 positioned to prevent the A-frame from lifting too high.

Figure 4:
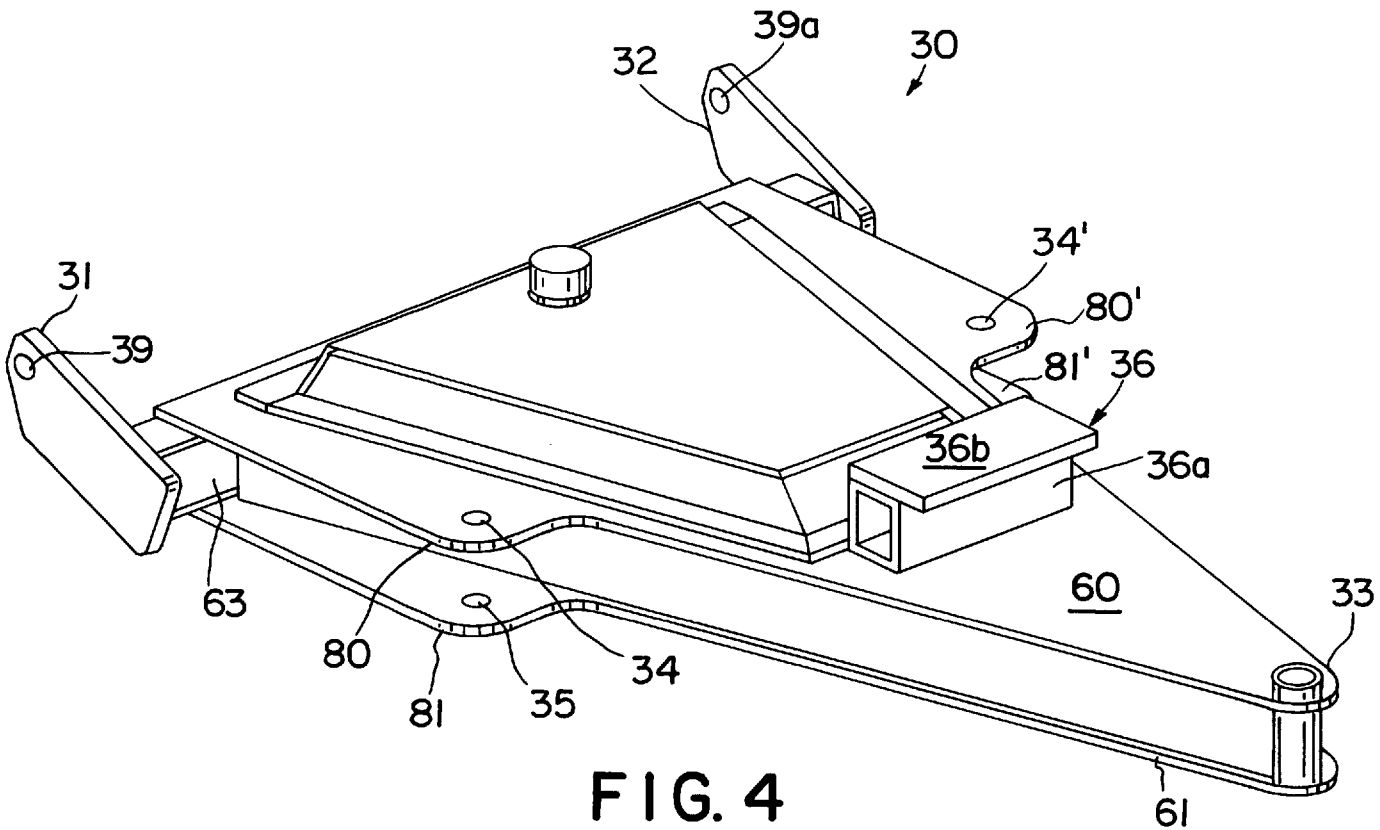
FIG. 4 is a perspective view of the A-frame in accordance with the present invention.
Figure 5:
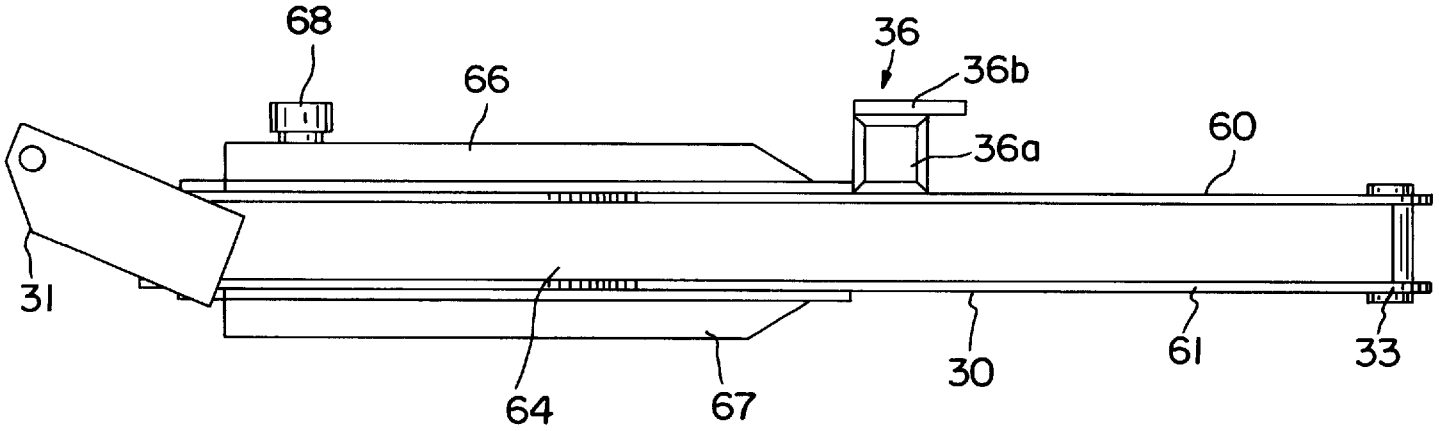
FIG. 5 is a side view of the A-frame in accordance with the present invention.

Turning now to FIGS. 4 and 5, the A-frame 30 is shown. The A-frame 30 is defined by a top plate 60 and an opposite, substantially co-extensive and spaced parallel bottom plate 61. The rear of the A-frame 30 includes a pair of spaced apart A-frame chassis pivots 31, 32 coupled to cross bar 63. The pivots 31, 32 interface to the chassis frame 11 to detachably mount the A-frame thereto. Pin holes 39, 39*a* are provided through each pivot 31, 32 for this purpose, allowing releasable mounting of the A-frame 30 to each clevis ear 16, 17 of the chassis frame 11, best seen in FIG. 1. The A-frame can thus be freely raised or lowered by rotating about the axis defined by the pin holes 39, 39*a*. At that apex or front of the A-frame there is a single vertical pivot means 33 for pivotal mounting to the trip frame that allows the snow blade and trip mechanism to pivot side-to-side as described in greater detail below. A pair of horizontal actuator intermediate axially aligned pivot locations 34, 34', 35, 35' are provided on shoulders 80, 80', 81, 81' in each plate 60, 61 of the A-frame for purposes described below. A ring block 36 comprising a tubular base section 36*a* and a top plate 36*b* is mounted on the top surface of the A-frame and mates to a stabilizer ½ ring attached to the trip frame 60. The block 36 contains and stabilizes the ½ ring, thus stabilizing the trip frame to which the ½ ring is attached. Those skilled in the art will appreciate that the ring block 36 can be designed having shapes other than that shown, as long as the ring properly stabilizes the trip frame assembly 60.

Located in the body of the A-frame substantially between top and bottom surfaces 60, 61 is an actuator drive cavity 64. Locating the actuator drive means (preferably an electric/hydraulic pump assembly) substantially within the body of the A-frame 30 lightens the lift frame 20 (where the pump was conventionally located) for easy removal. Instead, the dead weight of the actuator drive means is advantageously added to the blade, assisting in creating a cleaner snowplow pass. Importantly, the actuator drive means in this location in no way obstructs the radiator of the vehicle, thereby allowing proper air flow to cool the vehicle engine and help prevent overheating. In addition, the actuator drive means is well sheltered, minimizing potential damage as the vehicle approaches the blade assembly for mounting. It also allows for shorter hydraulic lines to the angle pistons, requires only one quick disconnect to the vertical lift actuator, and allows for more clearance in the basic geometry, thereby allowing higher blade motion for stacking snow. Preferably, the bulk of the actuator drive means is located substantially in the horizontal plane of the A-frame defined by the top and bottom surfaces 60, 61. Most preferably, a lower recess/skid plate 67 (FIG. 5) coupled to the underside of plate 61 supports the pump assembly slightly below the plane of plate 61 of the A-frame 30, thereby maximizing the lift height of the A-frame 30. A removable top cover 66 optionally having a hydraulic fluid reservoir fill cap 68 provides further protection for the pump assembly.

Figure 6:
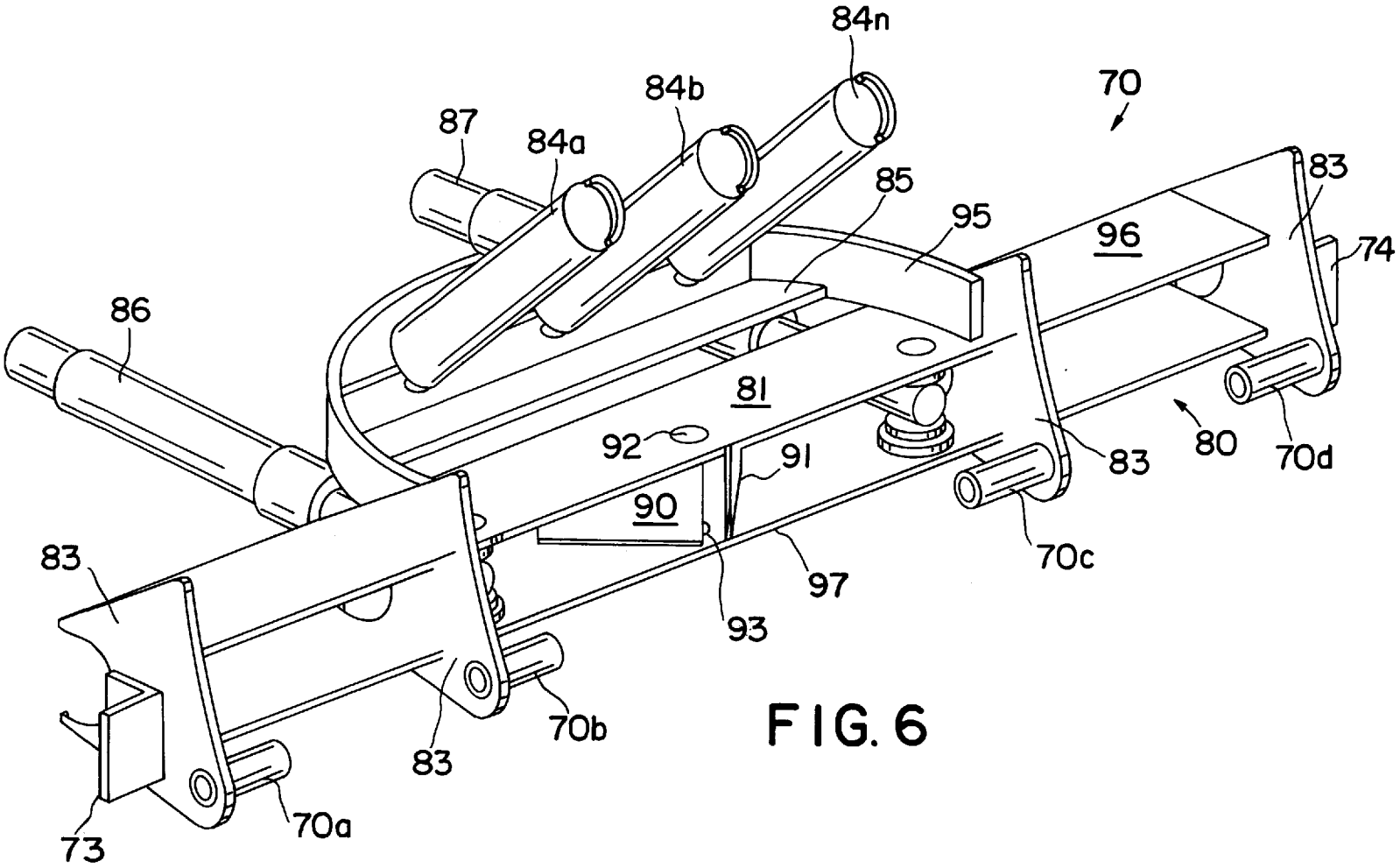
FIG. 6 is a perspective view of the trip frame in accordance with the present invention.
Figure 9B:
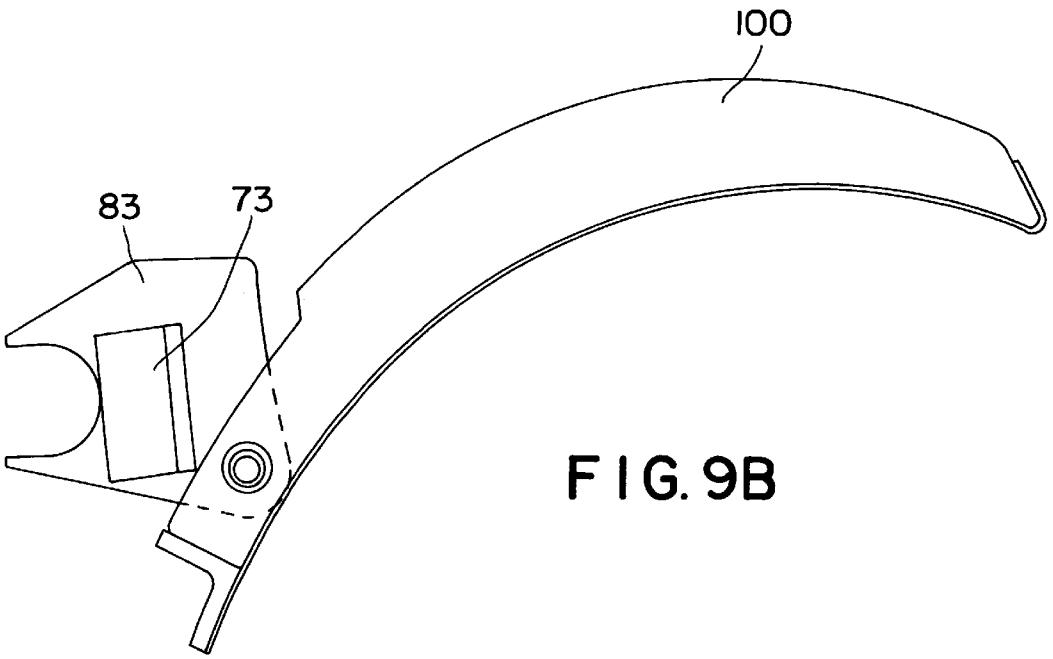
FIG. 9B is a side view of the snow blade in its full trip position in accordance with the present invention.
Figure 9A:
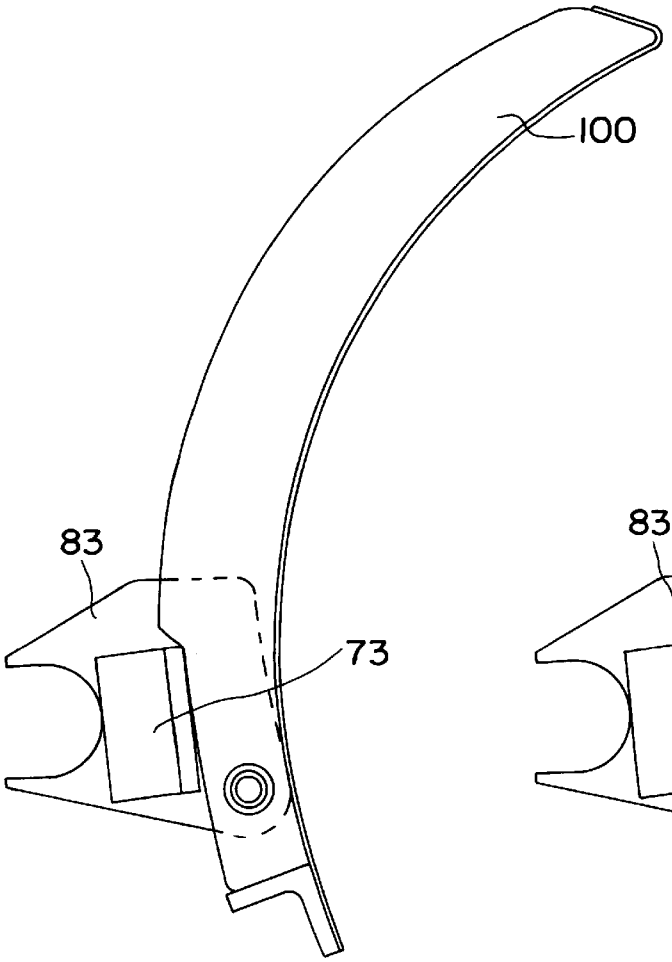
FIG. 9A is a side view of the snow blade in its full up position in accordance with the present invention.

FIG. 6 illustrates the preferred means for attaching the snow blade to the A-frame 30, the preferred means being in the form of a trip frame assembly 70. The trip frame 70 allows the blade to pivot forward, which allows it to trip over obstacles and absorb shock that would otherwise be transferred into the plow frame assembly and vehicle, which in extreme cases would cause substantial damage. The front of the trip frame 70 is defined by a trip frame angle pivot 82, which comprises a top horizontal plate 96 and a spaced, parallel, co-extensive bottom horizontal plate 97. Angled plates 90, 91 receive the apex of the A-frame and provide a stop. The A-frame is pivotally mounted through axially aligned holes 92, 93 in horizontal plates 96, 97, respectively. The trip frame angle pivot 82 includes four horizontal axially aligned pivot bushings 70*a*–70*d* each mounted on a rib 83 intersecting horizontal top and bottom plates 96, 97. The pivot bushings 70 each mate to a recess 71 (FIG. 7) formed in the back of the plow blade. Welded at extreme opposite ends of trip frame 70 are right angle blade trip stops 73, 74. These provide an angled stop against the vertical blade rib 101 as shown in FIGS. 9A and 9B. In FIG. 9A, the blade 100 is stopped in its full up position, whereas in FIG. 9B, the blade 100 is stopped in the full trip position. Were the blade 100 allowed to trip forward all the way to the ground, it could become lodged or could spring board up very abruptly, causing damage. In addition, the lower stop keeps the spring extension within its designed operating range which prevents the springs from overstretching (overstretching of the springs permanently damages the springs, making them unable to return the blade to its full upright position).

Those skilled in the art will recognize that the foregoing trip frame assembly is not required; the snow blade can articulate directly from the A-frame and by being directly coupled thereto via pistons and pivots.

Welded on the top cross bar 96 is the ½ ring 95 mentioned above, which stabilizes the trip assembly and pivot. A right angle cross bar 85 is positioned within the ½ ring 95, and supports a plurality of trip return springs means 84*a*–84*n* (three shown). The opposite ends of the return springs means 84 are coupled to the snow blade through the upper spring mount 90 (FIG. 7).

A pair of spaced horizontal actuators such as cylinders 86, 87 are each mounted at one end between top and bottom horizontal plates 81, 82 as shown in FIG. 6. The opposite ends of each horizontal actuator 86, 87 are pivotally coupled to the A-frame at shoulders 80, 80', 81, 81' as shown in FIGS. 1 and 4. These horizontal actuators 86, 87 are operatively connected to the actuator drive assembly (not shown) housed in cavity 64 by suitable hosing.

Figure 7:
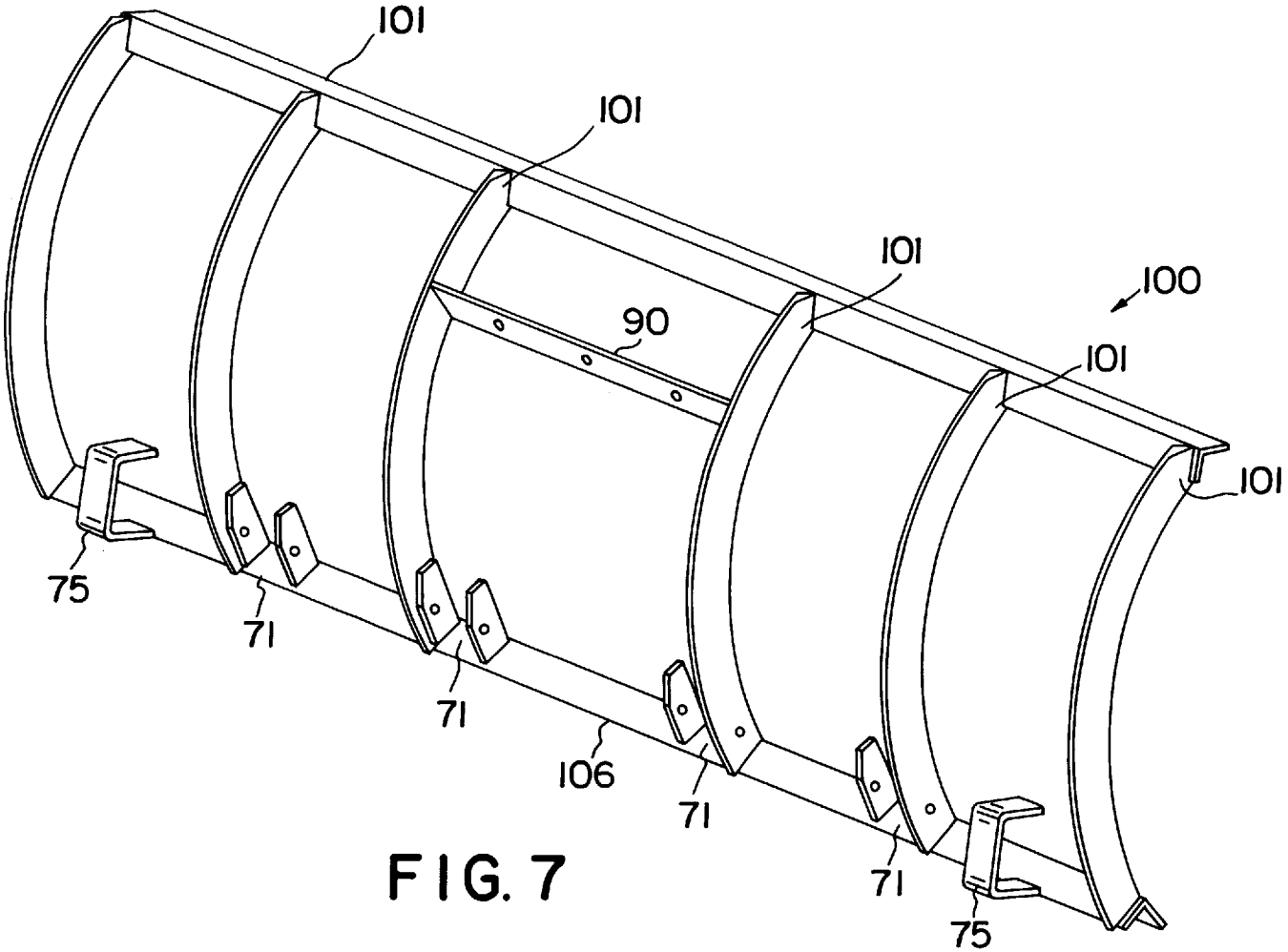
FIG. 7 is a rear perspective view of the snow blade in accordance with the present invention.

FIG. 7 shows the snow blade 100, which can be conventional in design. The preferred blade 100 shown is a sheet of steel bumped or rolled to a semi-round shape and then braced on the backside with a plurality of vertical ribs 101 and horizontal members comprised of formed stiffeners and a frog angle 102 at the very base to absorb shock. C-shaped shoe mounts 75 (FIG. 7) coupled to the back of the plow blade provide a surface for the blade to ride on.

Other utilitarian vehicle accessories having a pair of arms can be attached using the chassis mount of the present invention, including push bars, trailer hitches, winches, brush bars, brooms, and compartments for holding tools.

The controls for operating the assembly are housed inside the cab of the vehicle for easy access to the operator. Typically, there are two separate momentary contact switches in any position but the down position, where it is not momentary. A plurality of solenoids are used to control the mechanism, such as a solenoid to control the power that runs the motor for the pump. This circuit is energized off of any of the control positions except the down position, thereby actuating the pump to raise and/or angle the blade. Gravity allows the blade to return to ground. Three hydraulic solenoids are mounted to the output manifold of the pump. One is the unit that opens the path to lift or lower the blade assembly. In the up position, this solenoid opens the valve and the pump is energized, which raises the blade. In the down position, the solenoid also opens the valve, but the pump is not energized, which allows the blade to lower.

There are two hydraulic valves for the angling of the blade. As the switch is pushed to one side, it opens the corresponding valve and energizes the pump, which then pumps fluid into the corresponding piston which causes the piston to extend and to thereby angle the blade. At the same time, it allows the non-pressurized piston to collapse and fluid to return to the tank (the force of the extending piston collapses the opposite piston). When the switch is engaged in the other direction, the reverse occurs.

What is claimed is:

1. A snow blade mounting assembly for a vehicle having a chassis, comprising:

a chassis frame adapted to be fixed to said vehicle chassis, said chassis frame comprising means for detachably receiving a lift assembly, said lift assembly comprising:

a lift frame having a pair of spaced apart arms for mounting to said chassis frame receiving means;

an A-frame having a first end comprising means for detachably mounting to said chassis frame, and a second end spaced from said first end comprising snow blade pivot means, and having between said first end and said second end a cavity;

actuator drive means mounted to said A-frame in said cavity for lifting said snow blade; and snow blade mounting means for pivotally mounting said snow blade to said A-frame pivot means.

2. The snow blade mounting assembly of claim 1, wherein said snow blade mounting means comprises a trip frame pivotally mounted to said A-frame pivot means.

3. The snow blade mounting assembly of claim 1, wherein said means for detachably receiving a lift assembly on said chassis frame comprises a pair of spaced sockets.

4. The snow blade mounting assembly of claim 1, wherein said actuator drive means comprises an electric/hydraulic pump.

5. The snow blade mounting assembly of claim 4, wherein said lift assembly comprises at least one actuator driven by said actuator drive means for lifting said snow blade.

6. In a vehicle chassis mount for a snow blade, said vehicle chassis mount comprising:

a chassis frame adapted to be fixed to said vehicle chassis;

a lift frame detachably coupled to said chassis frame;

an A-frame detachably coupled to said chassis frame;

a trip frame pivotally coupled to said A-frame; and a snow blade pivotally coupled to said trip frame; the improvement wherein said A-frame comprises a compartment defined by a top plate and a bottom plate spaced from said top plate, and wherein actuator drive means for lifting said snow blade is positioned in said support frame compartment.

7. The vehicle chassis mount of claim 6, wherein said actuator drive means drives a pair of hydraulic pistons coupled to said A-frame and to said trip frame for pivoting said snow blade.

8. The vehicle chassis mount of claim 6, wherein said actuator drive means drives a hydraulic piston linked to said A-frame for lifting said snow blade relative to said vehicle.

9. A snow blade mounting assembly for a vehicle having a chassis, comprising:

a chassis frame adapted to be fixed to said vehicle chassis, said chassis frame comprising means for detachably receiving a lift assembly for causing vertical and horizontal movement of said snow blade, said lift assembly comprising:

a lift frame having a pair of spaced apart arms for mounting to said chassis frame receiving means;

an A-frame having a first end comprising means for detachably mounting to said chassis frame, and a second end spaced from said first end comprising snow blade pivot means, and having between said first end and said second end a cavity;

actuator drive means housed in said cavity, said actuator drive means comprising a hydraulic pump and an electric motor; and snow blade mounting means for pivotally mounting a snow blade to said A-frame pivot means.

* * * * *